US011365525B2

(12) United States Patent
Yamazaki et al.

(10) Patent No.: US 11,365,525 B2
(45) Date of Patent: Jun. 21, 2022

(54) REMOTE CONTROL DEVICE

(71) Applicant: IHI Corporation, Tokyo (JP)

(72) Inventors: Shunichi Yamazaki, Tokyo (JP); Hiroaki Hanawa, Tokyo (JP)

(73) Assignee: IHI CORPORATION, Tokyo (JP)

( * ) Notice: Subject to any disclaimer, the term of this patent is extended or adjusted under 35 U.S.C. 154(b) by 95 days.

(21) Appl. No.: 16/640,381

(22) PCT Filed: Aug. 23, 2018

(86) PCT No.: PCT/JP2018/031163
§ 371 (c)(1),
(2) Date: Feb. 20, 2020

(87) PCT Pub. No.: WO2019/039546
PCT Pub. Date: Feb. 28, 2019

(65) Prior Publication Data

US 2021/0071388 A1 Mar. 11, 2021

(30) Foreign Application Priority Data

Aug. 24, 2017 (JP) ..... JP2017-161199

(51) Int. Cl.
*E02F 9/20* (2006.01)
*G05G 1/54* (2008.04)

(52) U.S. Cl.
CPC ..... *E02F 9/205* (2013.01); *G05G 1/54* (2013.01)

(58) Field of Classification Search
CPC ..... E02F 9/205; G05G 1/54
See application file for complete search history.

(56) References Cited

U.S. PATENT DOCUMENTS

2002/0145334 A1* 10/2002 Kitai ..... B60W 30/18 303/190
2003/0055538 A1 3/2003 Yanaka
2005/0259075 A1 11/2005 Ishikawa et al.
2009/0163948 A1 6/2009 Sunaoshi et al.
2009/0250270 A1* 10/2009 Hauser ..... B62D 11/04 180/6.32
2010/0114451 A1* 5/2010 Fujii ..... F02D 29/02 701/99
2012/0159916 A1* 6/2012 Ishii ..... B60L 8/003 56/10.2 A (Continued)

FOREIGN PATENT DOCUMENTS

CN 102233932 A 11/2011
CN 106687645 A 5/2017

(Continued)

*Primary Examiner* — Peter D Nolan
*Assistant Examiner* — Demetra R Smith-Stewart
(74) *Attorney, Agent, or Firm* — Volpe Koenig

(57) ABSTRACT

A remote control device includes an electric drive unit controlling a control member, a position detection unit detecting a position of the control member, a control unit controlling operation of the electric drive unit, a reference position storage unit storing information related to a reference position of the control member, and an operation range setting unit setting an operation range of the control member from the reference position based on an output of the electric drive unit when the control member is displaced by the electric drive unit.

10 Claims, 12 Drawing Sheets

(56) References Cited

U.S. PATENT DOCUMENTS

| | | | | |
|---|---|---|---|---|
| 2013/0024079 | A1* | 1/2013 | Sekiya | F16H 61/32 701/51 |
| 2014/0229007 | A1 | 8/2014 | Kishi | |
| 2015/0308074 | A1 | 10/2015 | Zhdanov et al. | |
| 2017/0292247 | A1 | 10/2017 | Yokoo et al. | |
| 2018/0051446 | A1* | 2/2018 | Yoshinada | E02F 9/261 |
| 2018/0274207 | A1 | 9/2018 | Yokoo et al. | |
| 2018/0327997 | A1 | 11/2018 | Fujii et al. | |
| 2019/0111789 | A1* | 4/2019 | Matsuda | A01D 69/02 |

FOREIGN PATENT DOCUMENTS

| | | | |
|---|---|---|---|
| CN | 107002389 | A | 8/2017 |
| JP | 01-165825 | A | 6/1989 |
| JP | 09-217382 | A | 8/1997 |
| JP | 11-350535 | A | 12/1999 |
| JP | 2003-083107 | A | 3/2003 |
| JP | 2009-148859 | A | 7/2009 |
| JP | 2010-220955 | A | 10/2010 |
| JP | 2011-243101 | A | 12/2011 |
| JP | 2013-086206 | A | 5/2013 |
| WO | 88/06242 | A1 | 8/1988 |

* cited by examiner

REMOTE CONTROL DEVICE

TECHNICAL FIELD

The present disclosure relates to a remote control device.

BACKGROUND ART

For example, there is a remote control system capable of remotely controlling a construction machine or the like (for example, refer to Patent Literature 1). The remote control system disclosed in Patent Literature 1 includes a control means (for example, a control lever) for controlling a construction machine, a control driving means for driving the control means, and a control unit for controlling the control driving means based on control command information.

CITATION LIST

Patent Literature

Patent Literature 1: Japanese Unexamined Patent Publication No. H11-350535

SUMMARY OF INVENTION

Technical Problem

In a remote control system, a control unit recognizes a positional relationship between a control member and a control driving means. For example, in initial setting, a user stores a plurality of positions of the control member in a storage unit by manually controlling the control member such that it is displaced. Accordingly, the user stores a movable range of the control member in the storage unit.

An object of the present disclosure is to provide a remote control device in which work of a user when a position of a control member is stored in a storage unit can be simplified.

Solution to Problem

According to the present disclosure, there is provided a remote control device including an electric drive unit controlling a control member, a position detection unit detecting a position of the control member, a control unit controlling operation of the electric drive unit, a reference position storage unit storing information related to a reference position of the control member, and an operation range setting unit setting an operation range of the control member from the reference position based on an output of the electric drive unit when the control member is displaced by the electric drive unit.

Effects of Invention

According to the present disclosure, work of a user when a position of the control member is stored in the storage unit can be simplified.

DESCRIPTION OF EMBODIMENT

Figure 1:
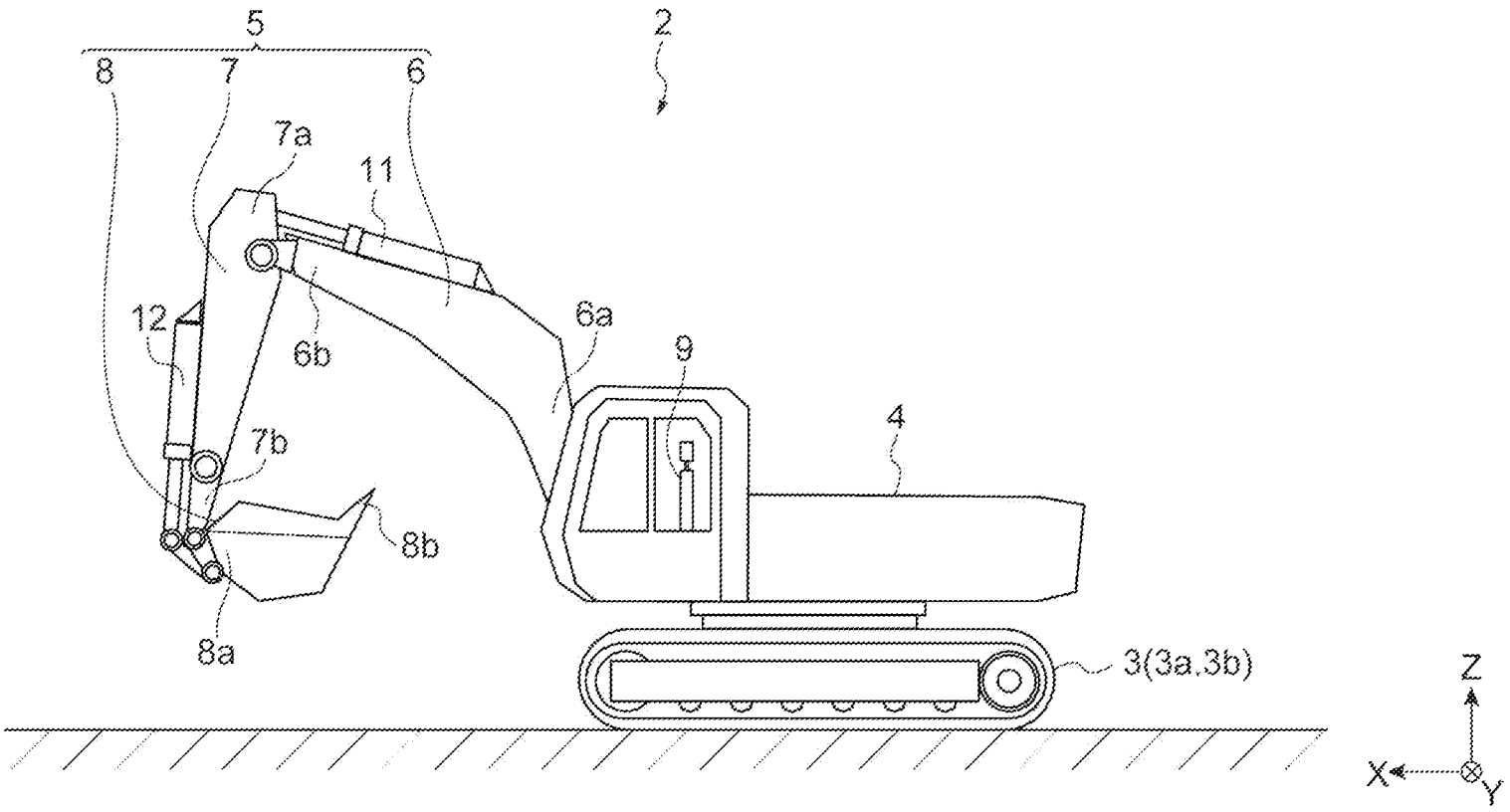
FIG. 1 is a side view illustrating a construction machine in which a remote control system of the present disclosure is applied.

A remote control device of the present disclosure includes an electric drive unit controlling a control member, a position detection unit detecting a position of the control member, a control unit controlling operation of the electric drive unit, a reference position storage unit storing information related to a reference position of the control member, and an operation range setting unit setting an operation range of the control member from the reference position based on an output of the electric drive unit when the control member is displaced by the electric drive unit.

In this remote control device, the control member can be driven and displaced by controlling the electric drive unit, and the control member can be remotely controlled. The remote control device includes the position detection unit detecting the position of the control member and stores information related to the reference position of the control member in the reference position storage unit. The control unit of the remote control device drives the control member such that it is displaced and sets the operation range of the control member from the reference position based on an output of the electric drive unit at this time. Accordingly, work of a user manually controlling the control member and storing the position of the control member is no longer necessary. Therefore, work of a user when the position of the control member is stored can be simplified. After the operation range of the control member is set, control in which the control member is displaced within a set operation range can be performed in the remote control device.

The control member may be an swingable control lever. The reference position storage unit may store a neutral position of the control lever as the reference position. The neutral position of the control lever is a position at which an input value of the control lever becomes zero and is a position for instructing a stop. The operation range setting unit can set the operation range of the control lever using the neutral position of the control lever as the reference position.

The electric drive unit may include an electric motor. The operation range setting unit may include a torque determination unit determining whether or not an output torque of the electric motor has exceeded a determination threshold. The operation range setting unit may set the position of the control member when the output torque exceeds the determination threshold as a boundary position of the operation range. Accordingly, when the output torque of the electric motor increases and exceeds the determination threshold, the position of the control lever at this time can be set as the boundary position of the operation range.

The control unit may perform control in which the control member is moved to be displaced in a first direction, may stop movement of the control member when the output torque exceeds the determination threshold, and may perform control in which the control member is moved to be displaced in a second direction toward a side opposite to the first direction after the control member stops. Accordingly, after the control member is displaced in the first direction, the control member is displaced in the second direction toward a side opposite thereto, and the operation range of the control member can be set.

Hereinafter, a preferable embodiment of the present disclosure will be described in detail with reference to the drawings. The same reference signs are applied to the same parts or corresponding parts in description of each of the drawings, and duplicate description will be omitted.

First, with reference to FIG. 1, a construction machine 2 in which a remote control system (remote control device) 1 is applied will be described. The construction machine 2 is a backhoe, for example. The construction machine 2 includes a traveling body 3 causing the construction machine 2 to travel, a swiveling body 4 provided in an upper portion of the traveling body 3 and capable of swiveling, and a working unit 5 attached to the swiveling body 4. The working unit 5 includes a boom 6, an arm 7, and a bucket 8. The construction machine 2 is not limited to a backhoe and may be a different construction machine such as a bulldozer, a crane, or a crawler dump truck, for example. A working machine, in which the remote control system 1 is applied, is not limited to a construction machine and may be a different working machine such as an agricultural machine, a conveying machine, or a working vehicle.

The swiveling body 4 includes an operator's seat 9, and a control lever (control member) 10 (which will be described below) is provided in the operator's seat 9. An engine, a generator, a battery, a hydraulic pump, and the like are mounted in the swiveling body 4. In each diagram, three directions orthogonal to each other are illustrated as a front-rear direction X, a left-right direction Y, and an up-down direction Z. The front-rear direction X, the left-right direction Y, and the up-down direction Z are set with reference to the operator's seat 9.

The traveling body 3 includes a left crawler 3*a* and a right crawler 3*b*. The construction machine 2 can perform forward movement, rearward movement, and direction changing of the traveling body 3 by controlling rotation directions of the left crawler 3*a* and the right crawler 3*b*.

The swiveling body 4 is rotatable around a rotation axis extending in the up-down direction Z with respect to the traveling body 3. The construction machine 2 can swivel the swiveling body 4 to the right and left.

The boom 6 is attached to the front of the swiveling body 4 and is able to swing around the rotation axis extending in the left-right direction Y. A proximal end portion 6*a* of the boom 6 is joined to the swiveling body 4. The boom 6 for swinging a hydraulic cylinder (not illustrated) is provided in the swiveling body 4. The construction machine 2 can move a distal end portion 6*b* of the boom 6 upward and downward by driving the hydraulic cylinder such that the boom 6 swings.

The arm 7 is attached to the boom 6 and is able to swing around the rotation axis extending in the left-right direction Y. A proximal end portion 7*a* of the arm 7 is joined to the distal end portion 6*b* of the boom 6. The arm 7 for swinging a hydraulic cylinder 11 is provided in the boom 6. The construction machine 2 can extend and draw the arm 7 by driving the hydraulic cylinder 11 such that the arm 7 swings. Extending of the arm 7 is movement in a direction in which a distal end portion 7*b* of the arm 7 separates from the operator's seat 9. Drawing of the arm 7 is movement in a direction in which the distal end portion 7*b* of the arm 7 approaches the operator's seat 9.

The bucket 8 is attached to the arm 7 and is able to swing around the rotation axis extending in the left-right direction Y. A proximal portion 8*a* of the bucket 8 is joined to the distal end portion 7*b* of the arm 7. A hydraulic cylinder 12 for swinging the bucket 8 is provided in the arm 7. The construction machine 2 can perform a drawing operation of the bucket 8 and can perform an operation of dropping (dumping) a target inside the bucket 8 by driving the hydraulic cylinder 12 such that the bucket 8 swings. Drawing of the bucket 8 is movement in a direction in which a distal end portion 8*b* of the bucket 8 approaches the operator's seat 9. A movement of dropping a target inside the bucket 8 is movement in a direction in which the distal end portion 8*b* of the bucket 8 separates from the operator's seat 9.

Figure 2:
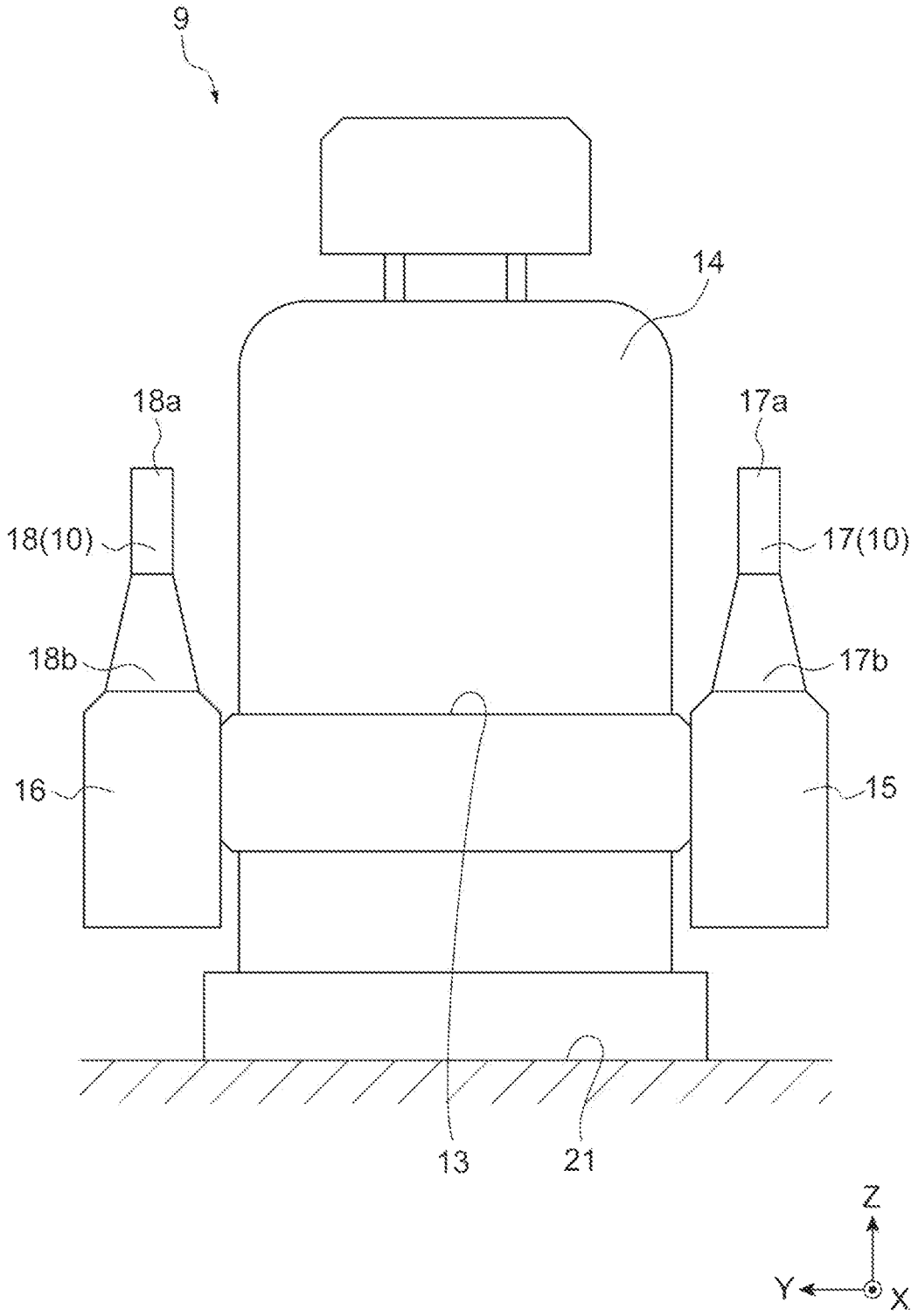
FIG. 2 is a front view illustrating an operator's seat of the construction machine illustrated in FIG. 1.
Figure 3:
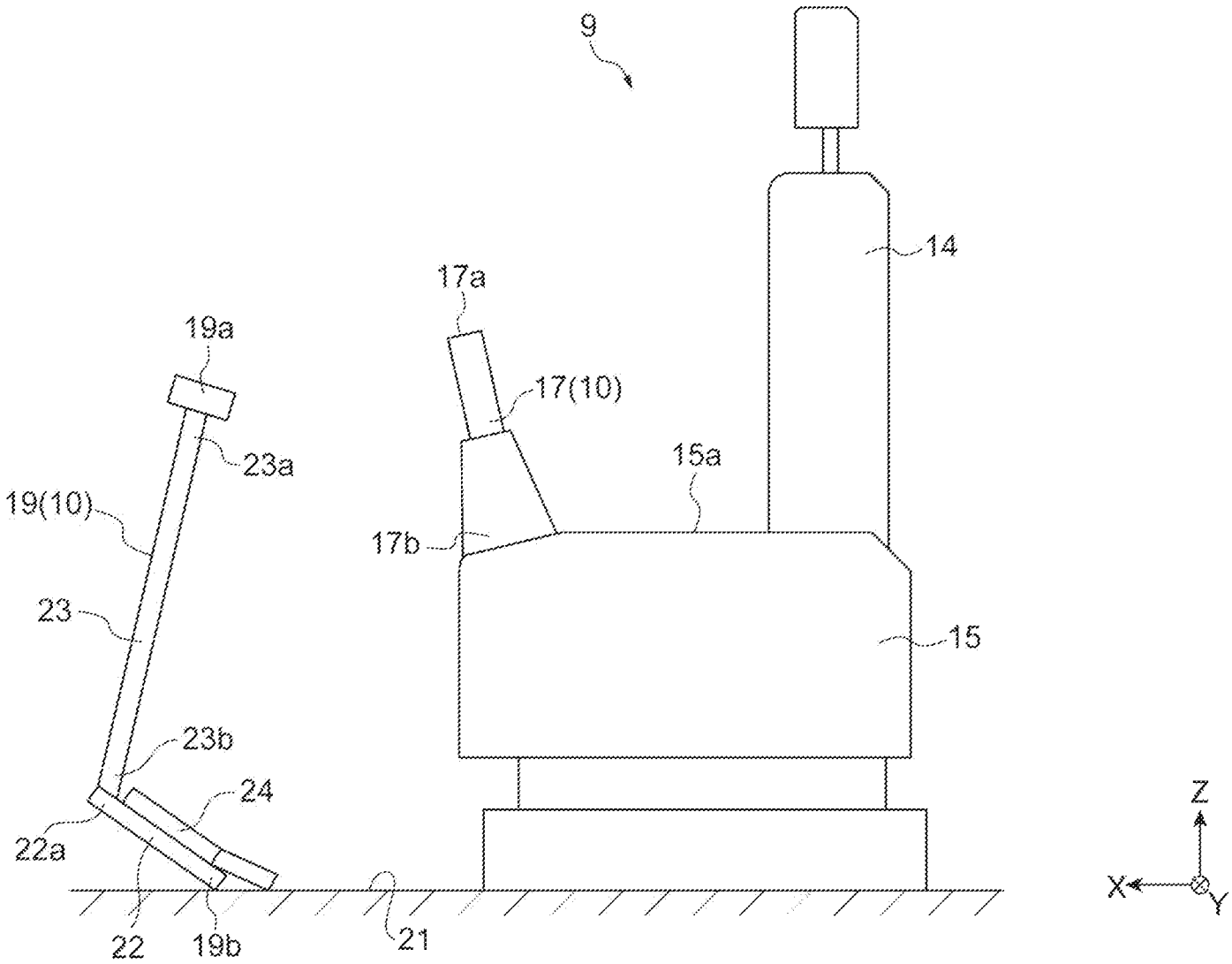
FIG. 3 is a side view of the operator's seat illustrated in FIG. 2.
Figure 4:
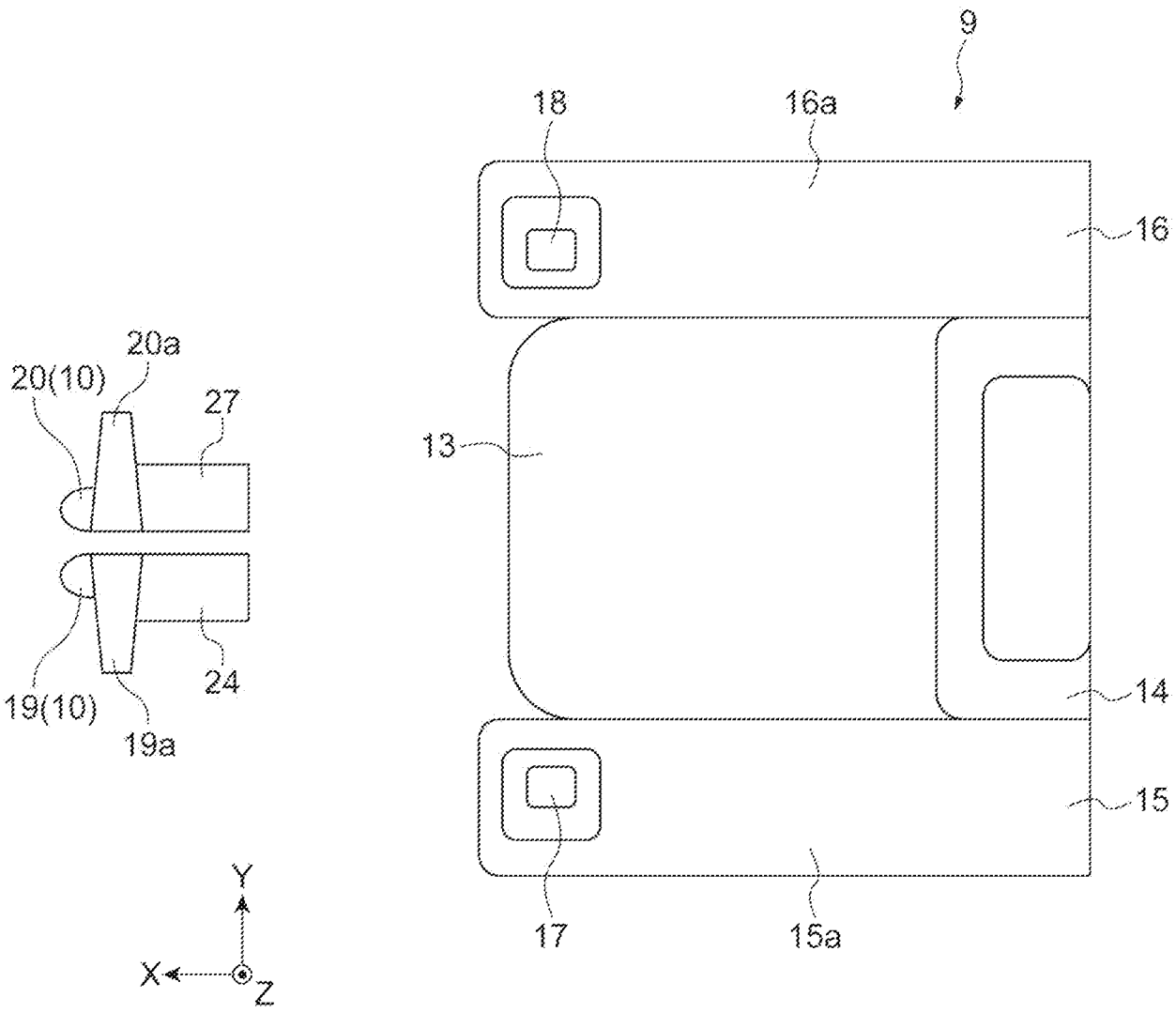
FIG. 4 is a plan view of the operator's seat illustrated in FIG. 2.

The operator's seat 9 illustrated in FIGS. 2 to 4 is a seat on which an operator operating the construction machine 2 can be seated. The operator's seat 9 includes a seat 13, a backrest 14, and left and right armrest portions 15 and 16. A plurality of control levers 10 for operating the construction machine 2 are provided around the operator's seat 9. The plurality of control levers 10 include a left working lever 17, a right working lever 18, a left traveling lever 19, and a right traveling lever 20. In the following description, when the left working lever 17, the right working lever 18, the left traveling lever 19, and the right traveling lever 20 are not distinguished from each other, they will be described as the control levers 10.

Figure 5B:
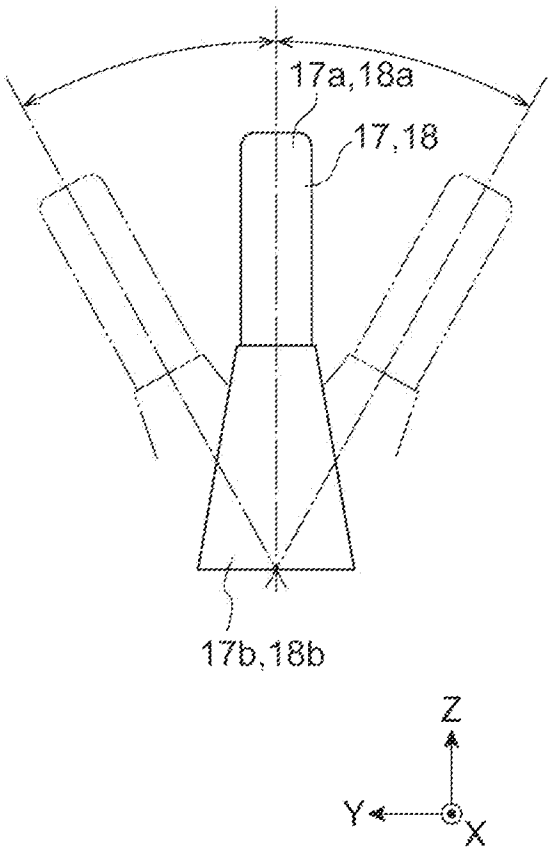
FIG. 5B is a front view illustrating an operation range of the working lever in a left-right direction.
Figure 5A:
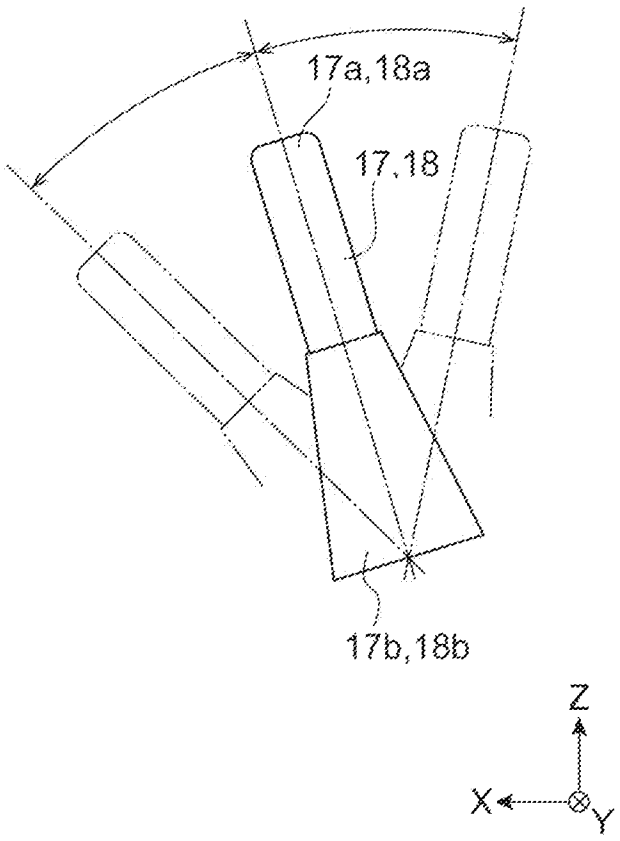
FIG. 5A is a side view illustrating an operation range of a working lever in a front-rear direction.

For example, the left working lever 17 is provided on a top surface 15*a* on the front side of the armrest portion 15 on the left side. As illustrated in FIGS. 2, 3, and 5, the left working lever 17 extends in the up-down direction Z, and an upper end portion 17*a* is disposed such that it tilts slightly to the front at a neutral point (neutral position) (refer to FIG. 5A). When viewed in the front-rear direction X, the left working lever 17 stands upright with respect to a predetermined surface at the neutral point (refer to FIG. 5B).

The neutral point is a position at which an input value of the control levers 10 becomes zero and is a position for instructing a stop. At the neutral point, the control levers 10 may be in a state of standing upright in the up-down direction Z or may be in a state of tilting to the rear. When viewed in the front-rear direction X, the control levers 10 may tilt to the seat 13 side, for example, at the neutral point.

In FIGS. 5A and 5B, states indicated by solid lines illustrate the left working lever 17 at the neutral point. The left working lever 17 is able to swing using a lower end portion 17*b* as a reference point. The upper end portion 17*a* of the left working lever 17 can move in the front-rear direction X and the left-right direction. The left working lever 17 is utilized for control of swiveling the swiveling body 4 and is utilized for control of extending or drawing the arm 7.

An operator can control the arm 7 by controlling the left working lever 17 in the front-rear direction X. Specifically, when the upper end portion 17*a* of the left working lever 17 is moved forward, the arm 7 extends, and when the upper end portion 17*a* of the left working lever 17 is moved rearward, the distal end portion 7*b* of the arm 7 approaches the operator's seat 9 side and is drawn.

An operator can control the swiveling body 4 by controlling the left working lever 17 in the left-right direction Y. Specifically, when the upper end portion 17*a* of the left working lever 17 is moved to the left side, the swiveling body 4 can swivel to the left so that the arm 7 can be moved to the left side, and when the upper end portion 17*a* of the left working lever 17 is moved to the right side, the swiveling body 4 can swivel to the right so that the arm 7 can be moved to the right side.

For example, the right working lever 18 is provided on a top surface 16*a* on the front side of the armrest portion 16 on the right side. The right working lever 18 extends in the up-down direction Z, and an upper end portion 18*a* is disposed such that it tilts slightly to the front at the neutral point. When viewed in the front-rear direction X, the right working lever 18 stands upright in the up-down direction Z at the neutral point.

In FIGS. 5(*a*) and 5(*b*), states indicated by solid lines illustrate the right working lever 18 at the neutral point. The right working lever 18 is able to swing using a lower end portion 18*b* as a reference point. The upper end portion 18*a* of the right working lever 18 can move in the front-rear direction X and the left-right direction Y The right working lever 18 is utilized for control of moving the boom 6 upward and downward and is utilized for control of the bucket 8.

An operator can control the boom 6 by controlling the right working lever 18 in the front-rear direction X. Specifically, when the upper end portion 18*a* of the right working lever 18 is moved forward, the distal end portion 6*b* of the boom 6 can be moved downward, and when the upper end portion 18*a* of the right working lever 18 is moved rearward, the distal end portion 7*b* of the boom 6 can be moved upward.

An operator can control the bucket 8 by controlling the right working lever 18 in the left-right direction Y. Specifically, when the upper end portion 18*a* of the right working lever 18 is moved to the left side, a drawing operation of the bucket 8 can be performed, and when the upper end portion 18*a* of the right working lever 18 is moved to the right side, an operation of dropping a target inside the bucket 8 can be performed.

Figure 6:
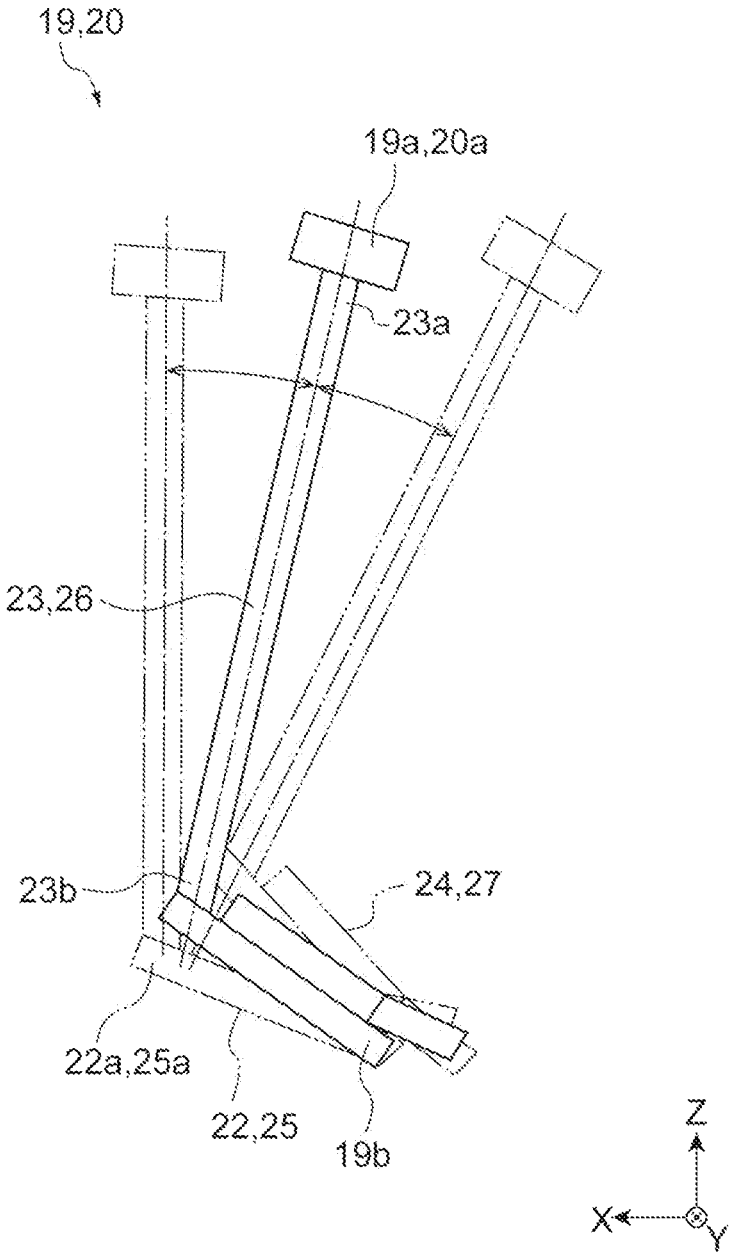
FIG. 6 is a side view illustrating an operation range of a traveling lever in the front-rear direction.

For example, the left traveling lever 19 is disposed in front and on the left side of the center of the operator's seat 9. The left traveling lever 19 extends upward from a floor surface 21 in front of the operator's seat 9. As illustrated in FIGS. 3, 4, and 6, the left traveling lever 19 includes a proximal portion 22 extending forward from the floor surface 21, and a lever main body 23 extending upward from a distal end 22*a* of the proximal portion 22. A left pedal 24 is joined to the proximal portion 22. The lever main body 23 extends such that it tilts obliquely to the rear. For example, in the left traveling lever 19 at the neutral point, an upper end portion 23*a* of the lever main body 23 is disposed behind a lower end portion 23*b*. A grip 19*a* protruding to the left side is provided in the upper end portion 23*a* of the lever main body 23. For example, an operator can control the left traveling lever 19 by controlling the grip 19*a* or the left pedal 24.

In FIG. 6, the left traveling lever 19 at the neutral point is indicated by a solid line. The left traveling lever 19 is able to swing using a lower end portion 19*b* as a reference point. The grip 19*a* in the upper end portion of the left traveling lever 19 can move in the front-rear direction X. The left traveling lever 19 is utilized for instructing rotation control of the left crawler 3*a*.

An operator can control the rotation direction of the left crawler 3*a* by controlling the left traveling lever 19 in the front-rear direction X. Specifically, when the grip 19*a* of the left traveling lever 19 is moved forward, the left crawler 3*a* rotates in a direction in which it moves forward, and when the grip 19*a* of the left traveling lever 19 is moved rearward, the left crawler 3*a* rotates in a direction in which it moves rearward. When the left traveling lever 19 is disposed at the neutral point, rotation of the left crawler 3*a* can be stopped.

For example, the right traveling lever 20 is disposed in front and on the right side of the center of the operator's seat 9. The right traveling lever 20 extends upward from the floor surface 21 in front of the operator's seat 9. The right traveling lever 20 includes a proximal portion 25 extending forward from the floor surface 21, and a lever main body 26 extending upward from a distal end portion 25*a* of the proximal portion 25. A right pedal 27 is joined to the proximal portion 25. The lever main body 26 extends such that it tilts obliquely to the rear. For example, in the right traveling lever 20 at the neutral point, an upper end portion 26*a* of the lever main body 26 is disposed behind a lower end portion 26*b*. A grip 20*a* protruding to the right side is provided in the upper end portion 26*a* of the lever main body 26. For example, an operator can control the right traveling lever 20 by controlling the grip 20*a* or the right pedal 27.

Figure 7:
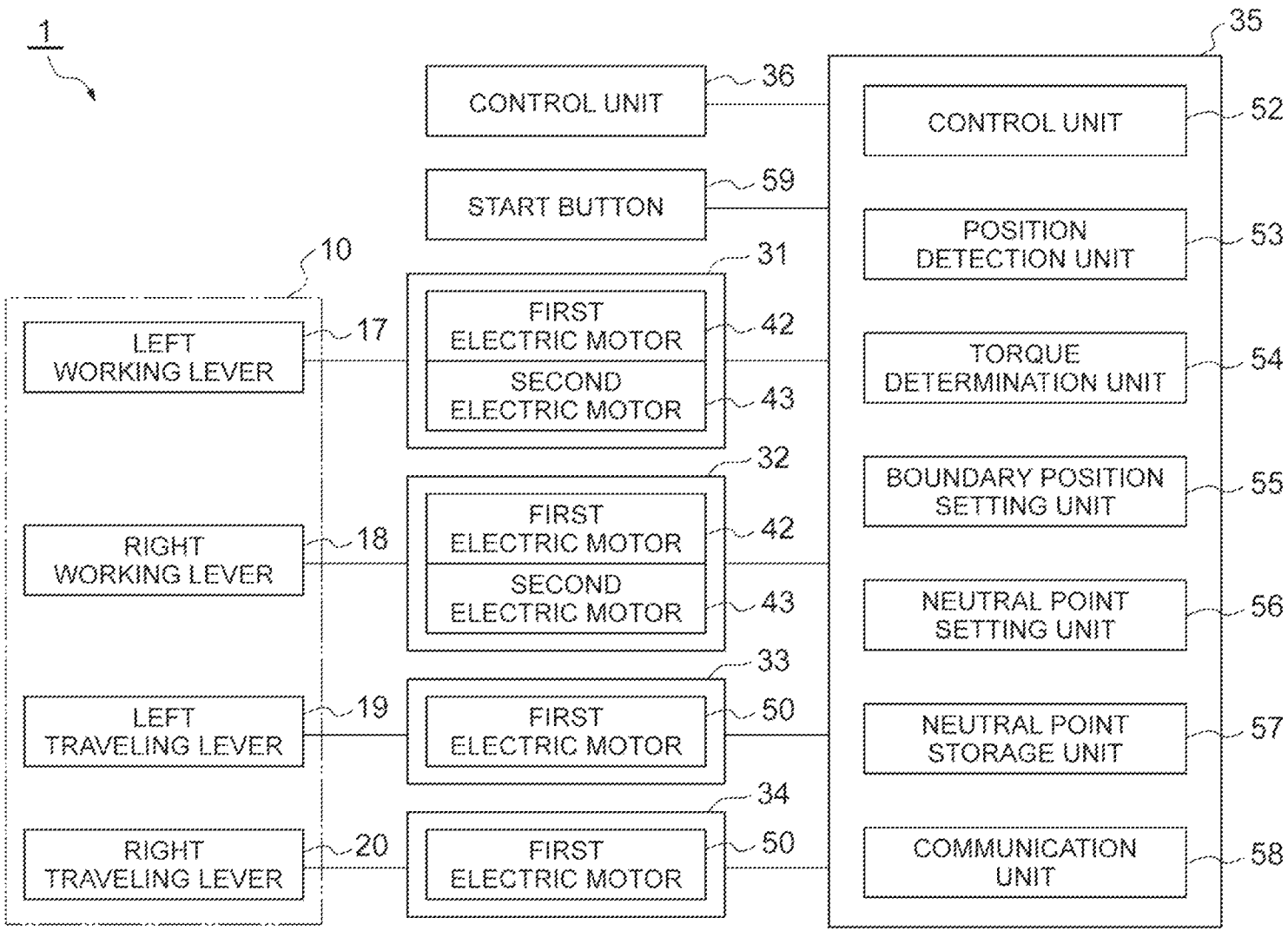
FIG. 7 is a block constitution diagram illustrating the remote control system of the present disclosure.

Next, the remote control system 1 remotely controlling the construction machine 2 will be described. As illustrated in FIG. 7, the remote control system 1 includes a plurality of drive units (electric drive unit) 31 to 34 controlling various control levers 10, a controller 35 controlling the plurality of drive units 31 to 34, and a control unit 36 transmitting a command signal to the controller 35. The drive units 31 to 34 are disposed in the vicinity of the operator's seat 9 and control the control levers 10. FIGS. 2 to 4 illustrate states before the drive units 31 to 34 are installed.

The drive units 31 to 34 include the drive unit 31 controlling the left working lever 17, the drive unit 32 controlling the right working lever 18, the drive unit 33 controlling the left traveling lever 19, and the drive unit 34 controlling the right traveling lever 20.

Figure 8:
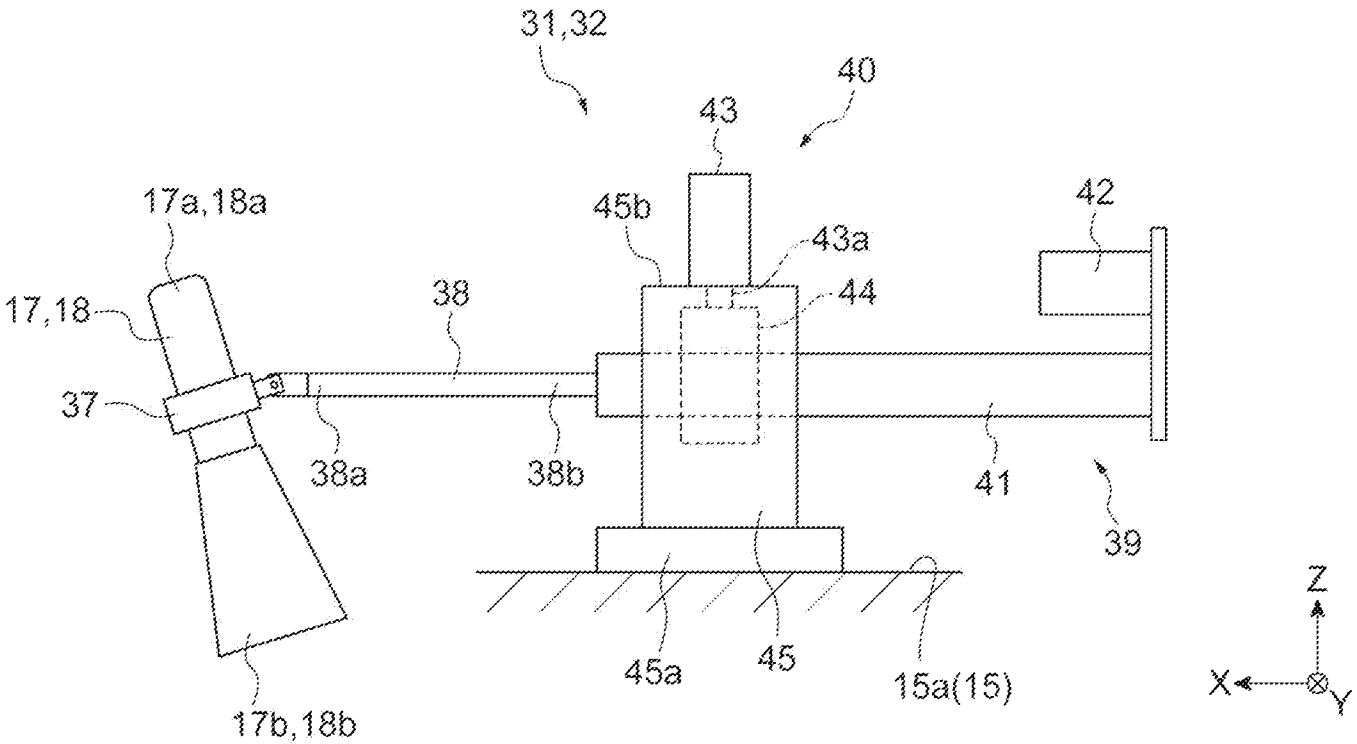
FIG. 8 is a side view illustrating a drive unit driving the working lever.
Figure 9:
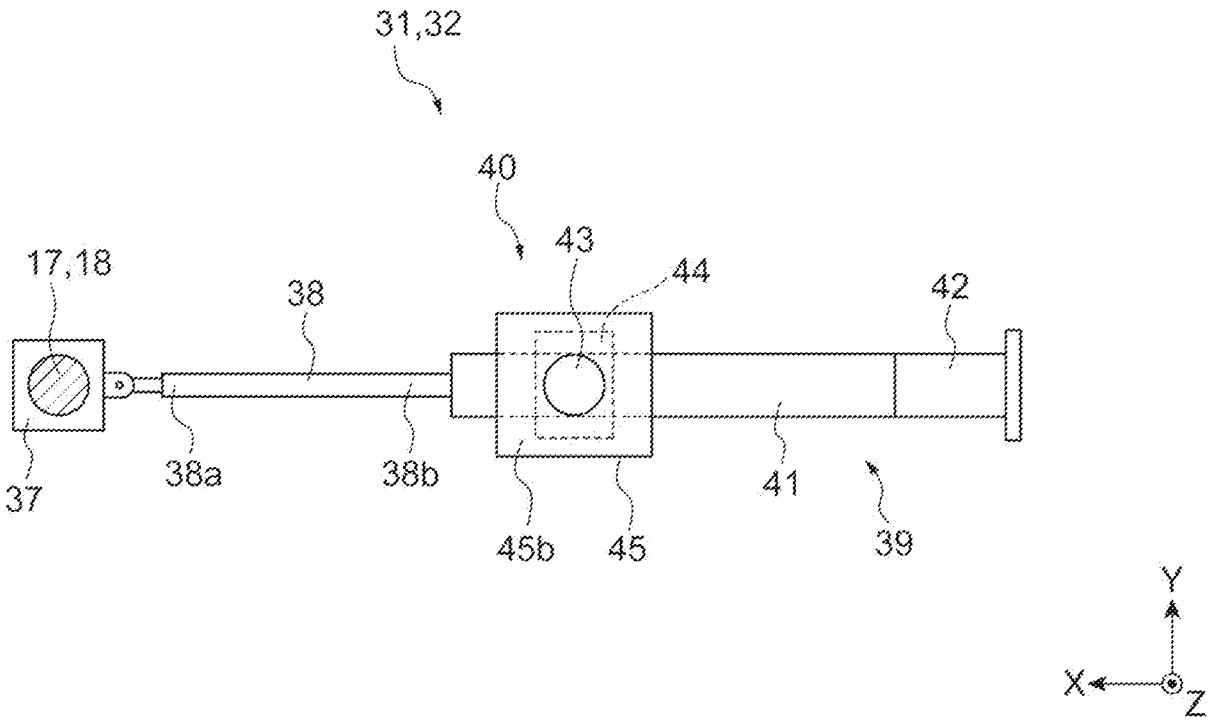
FIG. 9 is a plan view of the drive unit illustrated in FIG. 8.

As illustrated in FIGS. 8 and 9, the drive unit 31 controlling the left working lever 17 includes a holding unit 37 holding the left working lever 17, a power transmission member 38 joined to the holding unit 37, a first electric actuator 39 driving the power transmission member 38 in a longitudinal direction thereof, and a second electric actuator 40 swinging the power transmission member 38.

For example, the holding unit 37 includes a clamping member, which holds the left working lever 17. The holding unit 37 is joined to a distal end portion 38*a* of the power transmission member 38. For example, the power transmission member 38 exhibits a rod shape extending in the front-rear direction X in a state where the left working lever 17 is at the neutral point.

A rear end portion 38*b* of the power transmission member 38 is connected to the first electric actuator 39. The first electric actuator 39 includes a ball screw portion 41 and a first electric motor 42. The ball screw portion 41 extends in the longitudinal direction of the power transmission member 38. The ball screw portion 41 moves the power transmission member 38 in the longitudinal direction thereof. For example, when the power transmission member 38 extends in the front-rear direction X, the power transmission member 38 can move in the front-rear direction X and moves the upper end portion 17*a* of the left working lever 17 in the front-rear direction X.

For example, the first electric motor 42 is a stepping motor. An output shaft of the first electric motor 42 is joined to the ball screw portion 41, and an output of the first electric motor 42 is transmitted to the ball screw portion 41. Accordingly, the ball screw portion 41 can be driven. Regarding a transmission mechanism transmitting an output of the first electric motor 42 to the ball screw portion 41, for example, a gear, a rack, a belt, or the like can be used.

The second electric actuator 40 includes a second electric motor 43 and a rotation support portion 44. For example, the second electric motor 43 is a stepping motor. For example, an output shaft 43*a* of the second electric motor 43 extends in the up-down direction Z. The rotation support portion 44 rotatably supports the ball screw portion 41. The rotation support portion 44 is joined to the output shaft 43*a* of the second electric motor 43 and rotates around the output shaft 43*a*. Accordingly, the ball screw portion 41 can be rotated around the rotation axis extending in the up-down direction Z, and the upper end portion 17*a* of the left working lever 17 can be moved in the left-right direction Y.

The drive unit 31 includes a fixing support portion 45 fixing the drive unit 31 to the operator's seat 9. For example, the fixing support portion 45 exhibits a box shape. For example, a bottom plate 45*a* of the fixing support portion 45 is fixed to the top surface 15*a* of the armrest portion 15 on the left side in an attachable/detachable manner. For example, the bottom plate 45*a* is fixed to the armrest portion 15 using a clamping member, a bolt and a nut, or the like. The second electric motor 43 is fixed to a top plate 45*b* of the fixing support portion 45. The output shaft 43*a* of the second electric motor 43 penetrates the top plate 45*b* of the fixing support portion 45 and is joined to the rotation support portion 44 disposed inside the fixing support portion 45.

The drive unit 32 controlling the right working lever 18 has a constitution similar to that of the drive unit 31 controlling the left working lever 17, and therefore description thereof will be omitted herein.

Figure 10:
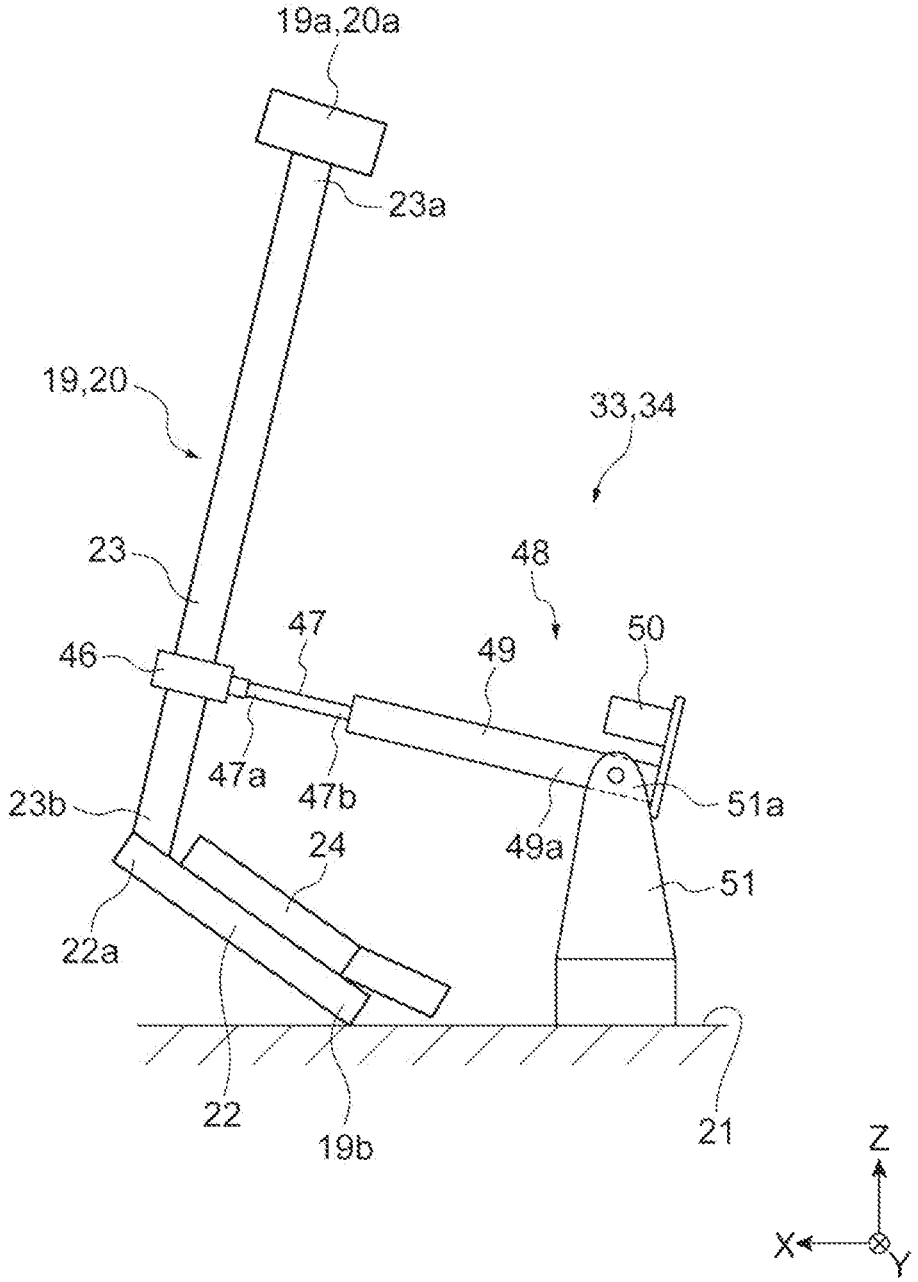
FIG. 10 is a side view illustrating the drive unit driving the traveling lever.

As illustrated in FIG. 10, the drive unit 33 controlling the left traveling lever 19 includes a holding unit 46 holding the left traveling lever 19, a power transmission member 47 joined to the holding unit 46, and a first electric actuator 48 driving the power transmission member 47 in a longitudinal direction thereof.

For example, the holding unit 46 includes a clamping member, which holds the left traveling lever 19. The holding unit 46 is joined to a distal end portion 47*a* of the power transmission member 47. For example, the power transmission member 47 exhibits a rod shape. The power transmission member 47 extends obliquely downward when viewed in the left-right direction Y.

A rear end portion 47*b* of the power transmission member 47 is connected to the first electric actuator 48. The first electric actuator 48 includes a ball screw portion 49 and a first electric motor 50. The ball screw portion 49 extends in the longitudinal direction of the power transmission member 47. The ball screw portion 49 moves the power transmission member 47 in the longitudinal direction thereof. For example, when the power transmission member 47 protrudes forward, the grip 19*a* in the upper end portion of the left traveling lever 19 is moved forward, and when the power transmission member 47 moves rearward, the grip 19*a* of the left traveling lever 19 is moved rearward.

The drive unit 33 includes a fixing support portion 51 fixing the drive unit 33 to the floor surface 21 in front of the operator's seat 9. The fixing support portion 51 is disposed such that it protrudes upward from the floor surface. A rear end portion 49*a* of the ball screw portion 49 is joined to an upper end portion 51*a* of the fixing support portion 51. The ball screw portion 49 supported by the fixing support portion 51 and is able to swing. For example, the posture of the ball screw portion 49 changes in accordance with an extension amount (stroke) of the power transmission member 47.

The drive unit 34 controlling the right traveling lever 20 has a constitution similar to that of the drive unit 33 controlling the left traveling lever 19, and therefore description thereof will be omitted herein.

Next, the controller 35 will be described with reference to FIG. 7.

The controller 35 is a computer constituted of hardware such as a central processing unit (CPU), a read only memory (ROM), and a random access memory (RAM); and software such as a program stored in the ROM. The controller 35 includes an input signal circuit, an output signal circuit, a power source circuit, and the like.

The controller 35 includes a control unit 52, a position detection unit 53, a torque determination unit 54, a boundary position setting unit (operation range setting unit) 55, a neutral point setting unit 56, a neutral point storage unit (reference position storage unit) 57, and a communication unit 58.

The control unit 52 controls the first electric motors 42 and 50 and the second electric motor 43 based on a command signal transmitted from the control unit 36. The control unit 52 can control each of the various control levers 10 by performing torque control of the first electric motors 42 and 50 and the second electric motor 43 and driving the first electric actuators 39 and 48 and the second electric actuator 40.

The position detection unit 53 detects positions of the various control levers 10. The position detection unit 53 can detect rotation positions of the output shafts of the first electric motors 42 and 50 and the second electric motor 43 by receiving signals from encoders attached to the first electric motors 42 and 50 and the second electric motor 43. The position detection unit 53 can detect the positions of the control levers 10 by computing the extension amounts and swing angles of the power transmission members 38 and 47 based on the rotation positions of the output shafts. For example, the positions of the control levers 10 may be positions of the upper end portions of the control levers 10, may be positions of the holding units 37 and 46, or may be other positions. The position detection unit 53 can detect the positions of the upper end portions of the control levers 10 from the neutral points with reference to the neutral points, for example.

Specifically, the position detection unit 53 can compute the extension amount of the power transmission member 38 by detecting a signal output from the encoder of the first electric motor 42. The position detection unit 53 can compute the swing angle of the power transmission member 47 by detecting a signal output from the encoder of the second electric motor 43. The position detection unit can compute the extension amount of the power transmission member 47 by detecting a signal output from the encoder of the first electric motor 50.

The torque determination unit 54 detects a value of a current supplied to the first electric motor 42 and determines whether or not this current value has exceeded the determination threshold. The torque determination unit 54 detects a value of a current supplied to the second electric motor 43 and determines whether or not this current value has exceeded the determination threshold. The torque determination unit 54 detects a value of a current supplied to the first electric motor 50 and determines whether or not this current value has exceeded the determination threshold. The controller 35 detects outputs of the drive units 31 to 34 by detecting values of currents supplied to the electric motors 42, 43, and 50.

The boundary position setting unit 55 sets the operation ranges of the control levers 10 based on results of the determination by the torque determination unit 54. The boundary position setting unit 55 sets the positions of the control levers 10 as boundary positions at the time when the respective current values exceed the determination thresholds. The boundary position setting unit 55 sets movable ranges from the neutral points as operation ranges with reference to the neutral points. The boundary position setting unit 55 can limit the operation ranges such that the control levers 10 do not move to the outer side beyond the boundary positions.

Figure 11:
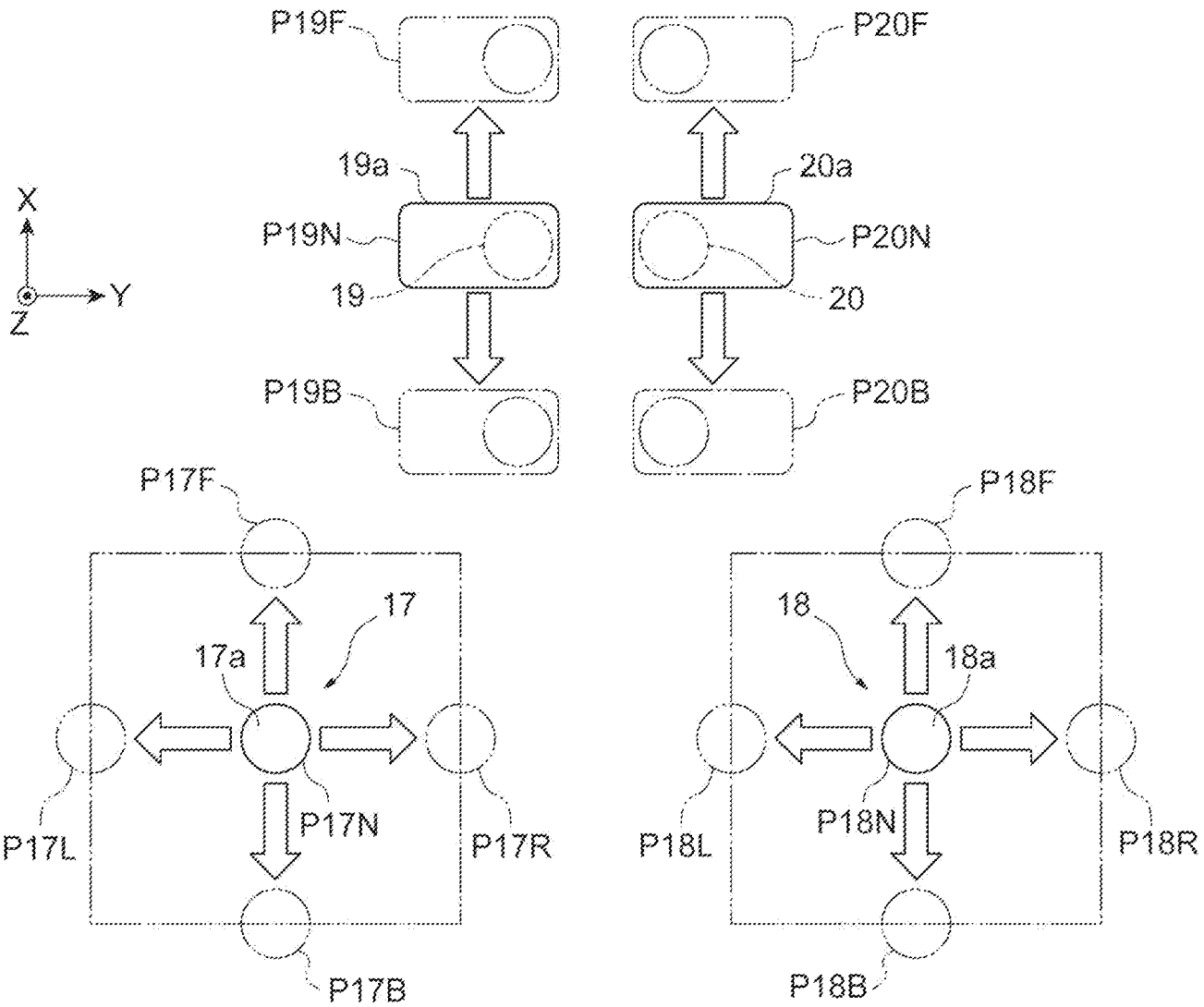
FIG. 11 is a plan view schematically illustrating the operation ranges of the working lever and the traveling lever.

FIG. 11 is a plan view schematically illustrating the operation ranges of the working lever and the traveling lever. In FIG. 11, the positions of the neutral points of the control levers 10 are indicated by solid lines, and the boundary positions of the operation ranges are indicated by two-dot dashed line.

A neutral point P17N is a position of the upper end portion 17*a* when the left working lever 17 is at the neutral point. A boundary position P17L is a boundary position on the left side, and a boundary position P17R is a boundary position on the right side. A boundary position P17F is a boundary position on the front side, and a boundary position P17B is a boundary position on the rear side.

A neutral point P18N is a position of the upper end portion 18*a* when the right working lever 18 is at the neutral point. A boundary position P18L is a boundary position on the left side, and a boundary position P18R is a boundary position on the right side. A boundary position P18F is a boundary position on the front side, and a boundary position P18B is a boundary position on the rear side.

A neutral point P19N is a position of the grip 19*a* when the left traveling lever 19 is at the neutral point. A boundary position P19F is a boundary position on the front side, and a boundary position P19B is a boundary position on the rear side.

A neutral point P20N is a position of the grip 20*a* when the right traveling lever 20 is at the neutral point. A boundary position P20F is a boundary position on the front side, and a boundary position P20B is a boundary position on the rear side.

In the remote control system 1, the control levers 10 are moved by operating the first electric motors 42 and 50 and the second electric motor 43, and the operation ranges are set by automatically detecting the boundary positions. Details thereof will be described below.

For example, the neutral point setting unit 56 sets the positions of the control levers 10 when a start button 59 is controlled as the neutral points P17N, P18N, P19N, and P20N. The neutral point setting unit 56 sets each of the neutral points P17N, P18N, P19N, and P20N for the left working lever 17, the right working lever 18, the left traveling lever 19, and the right traveling lever 20. Springs or the like are joined to the proximal end portions of the control levers 10 such that the control levers 10 return to the neutral points in a state where no force is acting on the control levers 10.

The neutral point storage unit 57 individually stores information related to the neutral point P17N of the left working lever 17, information related to the neutral point P18N of the right working lever 18, information related to the neutral point P19N of the left traveling lever 19, and information related to the neutral point P20N of the right traveling lever 20. Information related to the neutral points include the rotation angles of the output shafts of the first electric motors 42 and 50, the rotation angle of the output shaft of the second electric motor 43, and the like. The neutral point storage unit 57 may store information such as the extension amounts of the power transmission members 38 and 47 and the swing angle of the power transmission member 38 as information related to the neutral points.

The communication unit 58 performs radio communication with the control unit 36 and receives a command signal transmitted from the control unit 36.

The control unit 36 is a remote controller, and levers or the like with which a user can input control are provided therein. For example, in the control unit 36, a lever corresponding to the left working lever 17, a lever corresponding to the right working lever 18, a lever corresponding to the left traveling lever 19, and a lever corresponding to the right traveling lever 20 are individually provided.

The start button 59 is a button controlled by a user when the user starts control of setting the operation range of the left working lever 17, control of setting the operation range of the right working lever 18, control of setting the operation range of the left traveling lever 19, and control of setting the operation range of the right traveling lever 20.

Figure 12:
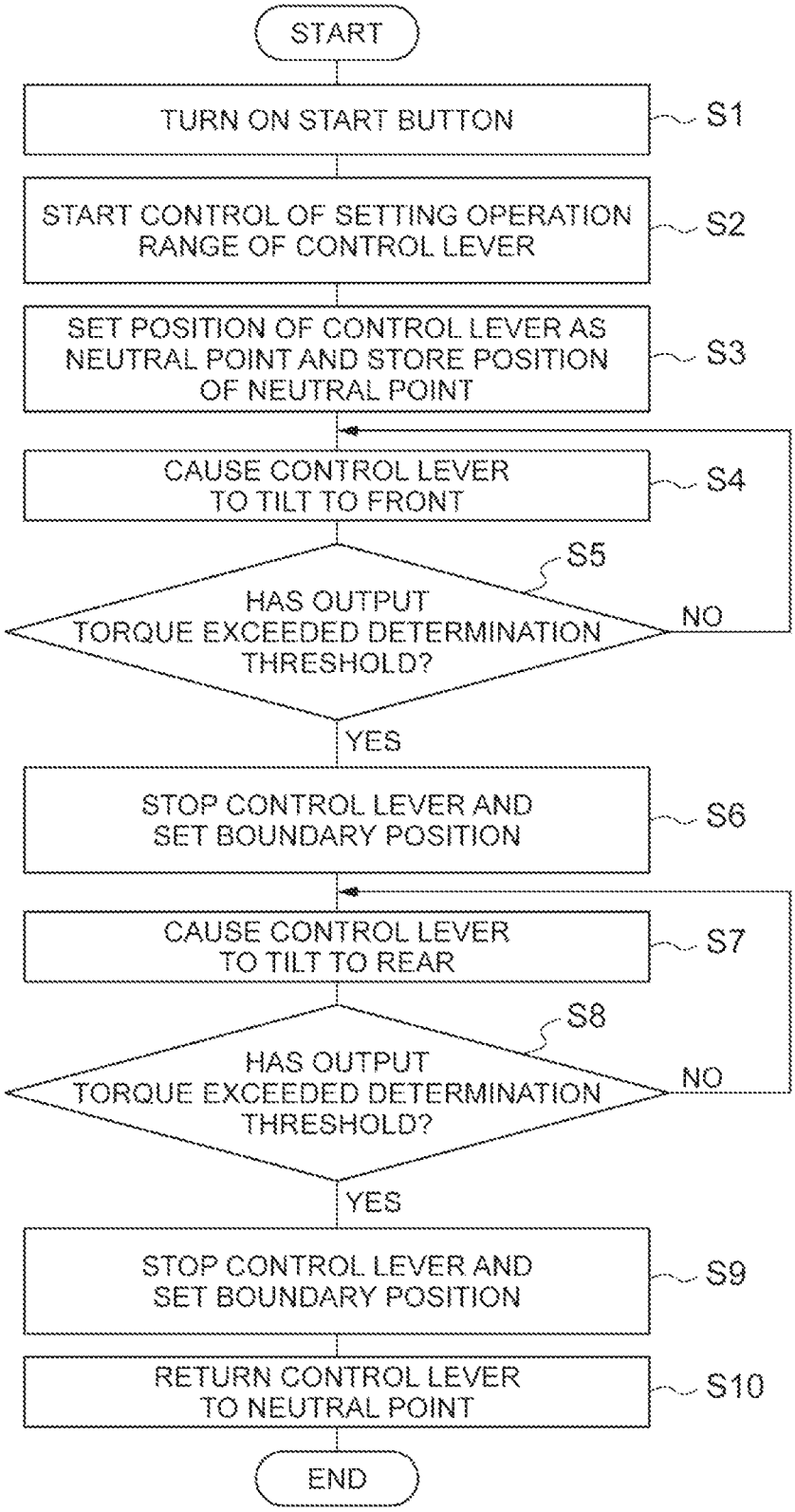
FIG. 12 is a flowchart showing a procedure when the operation range of the working lever is set.

Next, with reference to FIG. 12, a method for setting the operation ranges of the control levers 10 will be described. When the remote control system 1 is used, there is a need to install the drive units 31 to 34 in the control levers 10. After the drive units 31 to 34 are installed, there is a need to set the operation ranges of the control levers 10. Here, a method for setting the operation range of the left working lever 17 will be described.

First, a user installs the drive unit 31 and the controller 35 in the operator's seat 9 of the construction machine 2. At this time, the engine of the construction machine 2 is in a state of not being started, and a hydraulic system of the construction machine 2 is in a state of not being operated.

For example, the controller 35 is disposed on a rear surface side of the backrest 14 of the operator's seat 9. The drive unit 31 is fixed to the armrest portion 15. The holding unit 37 is joined to the left working lever 17. The holding unit 37 is fixed to the left working lever 17.

Next, the user manually controls the left working lever 17, checks for the position of the neutral point, and causes the left working lever 17 to be in a state of being disposed at the position of the neutral point.

Next, the user turns on the start button 59 (Step S1). When the start button 59 is controlled to be turned on, the controller 35 starts control of setting the operation range of the left working lever 17 (Step S2). The controller 35 starts a program for performing control of setting the operation range.

The neutral point setting unit 56 of the controller 35 recognizes and sets the position of the left working lever 17 when the program has started as the neutral point, and the neutral point storage unit 57 of the controller 35 stores information related to the position of the neutral point of the left working lever 17 (Step S3).

Next, the control unit 52 drives the first electric motor 42 to cause the left working lever 17 to tilt to the front (Step S4). The control unit 52 performs torque control of the first electric motor 42 to cause the output torque by the first electric motor 42 to be uniform. The ball screw portion 41 pushes out the power transmission member 38 to cause the left working lever 17 to tilt to the front. When a load for moving the left working lever 17 increases, the control unit 52 performs control of increasing the output torque in accordance therewith. As illustrated in FIG. 11, when the upper end portion 17*a* of the left working lever 17 moves forward (in the first direction) from the neutral point P17N and reaches the boundary position P17F within a controllable range, the output torque by the first electric motor 42 increases.

Next, the torque determination unit 54 determines whether or not the output torque by the first electric motor 42 has exceeded the determination threshold (Step S5). The torque determination unit 54 detects a value of a current supplied to the first electric motor 42, and when the current value has exceeded the determination threshold, the torque determination unit 54 determines that the output torque by the first electric motor 42 has exceeded the determination threshold (Step S5; YES). Similarly, when the current value has not exceeded the determination threshold, the torque determination unit 54 determines that the output torque by the first electric motor 42 has not exceeded the determination threshold (Step S5; NO).

When the output torque by the first electric motor 42 has exceeded the determination threshold (Step S5; YES), the process proceeds to Step S7. When the output torque by the first electric motor 42 has not exceeded the determination threshold, the process returns to Step S5 and continues movement of the left working lever 17. When the left working lever 17 recedes from the neutral point P17N and reaches the boundary position P17F within a controllable range, the output torque by the first electric motor 42 increases and exceeds the determination threshold.

When the output torque has exceeded the determination threshold (Step S5; YES), the control unit 52 stops a current to the first electric motor 42 and stops movement of the left working lever 17 (Step S6). The boundary position setting unit 55 stores the position of the left working lever 17 at this time in the storage unit. The boundary position setting unit 55 sets the position of the upper end portion 17*a* of the left working lever 17 as the boundary position P17F based on a value output from the encoder of the first electric motor 42.

Next, the control unit 52 drives the first electric motor 42 to cause the left working lever 17 to tilt to rear (Step S7). That is, the control unit 52 moves the left working lever 17 in a direction (second direction) opposite to the direction of movement of the left working lever 17 in Step S5. The control unit 52 performs torque control of the first electric motor 42 to cause the output torque by the first electric motor 42 to be uniform. The ball screw portion 41 brings back the power transmission member 38 to cause the left working lever 17 to tilt to rear.

Next, the torque determination unit 54 determines whether or not the output torque by the first electric motor 42 has exceeded the determination threshold (Step S8). The torque determination unit 54 detects a value of a current supplied to the first electric motor 42, and when the current value has exceeded the determination threshold, the torque determination unit 54 determines that the output torque by the first electric motor 42 has exceeded the determination threshold (Step S8; YES). Similarly, when the current value has not exceeded the determination threshold, the torque determination unit 54 determines that the output torque by the first electric motor 42 has not exceeded the determination threshold (Step S8; NO).

When the output torque by the first electric motor 42 has exceeded the determination threshold (Step S8; YES), the process proceeds to Step S9. When the output torque by the first electric motor 42 has not exceeded the determination threshold, the process returns to Step S7 and continues movement of the left working lever 17. When the left working lever 17 recedes from the neutral point P17N and reaches the boundary position P17B within a controllable range, the output torque by the first electric motor 42 increases and exceeds the determination threshold.

When the output torque has exceeded the determination threshold (Step S8; YES), the control unit 52 stops a current to the first electric motor 42 and stops movement of the left working lever 17 (Step S9). The boundary position setting unit 55 stores the position of the left working lever 17 at this time in the storage unit. The boundary position setting unit 55 sets the position of the upper end portion 17*a* of the left working lever 17 as a boundary position based on a value output from the encoder of the first electric motor 42.

Next, the control unit 52 controls the first electric motor 42 such that the left working lever 17 moves to return to the neutral point.

Next, the control unit 52 controls the second electric motor 43 to move the left working lever 17 in the left-right direction Y and sets the boundary positions P17L and P17R. Similar to setting (Step S5 to Step S9) of the boundary positions P17F and P17B in the front-rear direction X, the positions of the left working lever 17 when the output torque has exceeded the determination threshold are set as the boundary positions P17L and P17R and are stored in the storage unit.

Regarding the left working lever 17, when setting of the boundary position in the front-rear direction X and setting of the boundary position in the left-right direction Y have ended, processing herein ends.

Regarding the right working lever 18, similar to the left working lever 17, the controller 35 performs setting of the boundary positions P18F and P18B in the front-rear direction X and setting of the boundary positions P18L and P18R in the left-right direction Y and sets the operation range of the right working lever 18 (Step S2 to Step S10).

Regarding the left traveling lever 19, similar to the left working lever 17, the controller 35 performs setting of the boundary positions P19F and P19B in the front-rear direction X and sets the operation range of the left traveling lever 19 (Step S2 to Step S10).

Regarding the right traveling lever 20, similar to the left traveling lever 19, the controller 35 performs setting of the boundary positions P20F and P20B in the front-rear direction X and sets the control range of the right traveling lever 20 (Step S2 to Step S10).

In the remote control system 1 as described above, since the control levers 10 can be driven and displaced by controlling the drive units 31 to 34, the construction machine 2 can be operated by remotely controlling the control levers 10. The remote control system 1 includes the position detection unit 53, so that the positions of the control levers 10 can be detected and the information related to the neutral points can be stored in the neutral point storage unit 57 using the positions detected when the program has started are as the neutral points of the control levers 10.

The control unit 52 of the remote control system 1 drives the control levers 10 such that they are displaced and can set the operation ranges of the control levers 10 with reference to the neutral point based on the output torques of the first electric motors 42 and 50 and the second electric motor 43 at this time. Therefore, according to the remote control system 1, work of a user manually controlling the control levers 10 and storing the operation ranges of the control levers 10 is no longer necessary, and therefore work of a user can be simplified.

In the remote control system 1, since the control levers 10 can be controlled within the set operation ranges, control which may exceed the operation ranges can be curbed. Therefore, inconvenience due to an overload or the like in the first electric actuators 39 and 48 and the second electric actuator 40 can be prevented.

In the remote control system 1, the drive units 31 to 34 are disposed around the operator's seat 9, and the drive units 31 to 34 are not disposed on the seat 13 of the operator's seat 9 and the front surface of the backrest 14. Therefore, after the drive units 31 to 34 are installed, an operator is seated on the operator's seat 9 in accordance with the circumstances and can also operate the construction machine 2 by manually controlling the control levers 10.

The drive units 31 to 34 is attached to the construction machine 2 afterward (can be retrofitted). Therefore, the drive units 31 to 34 can be used by being installed as necessary. The drive units 31 to 34 can be used by being installed in a different construction machine 2. During this installation, since work of a user storing the positions of the control levers 10 in the storage unit is simple, a working time during installation can be shortened. As a result, the remote control system 1 having high versatility can be realized.

The present disclosure is not limited to the embodiment described above, and various modifications can be made as follows within a range not departing from the gist of the present disclosure.

In the foregoing embodiment, the control member has been described as a control lever. However, the control member is not limited to a control lever and may be a different control member such as a steering wheel or a pedal, for example.

In the foregoing embodiment, an electric drive unit having a ball screw portion has been described. However, the electric drive unit is not limited to a unit including a ball screw portion and may be a unit including a different actuator such as a cylinder, for example.

In the foregoing embodiment, the positions of the neutral points are set as the reference positions. However, positions shifted from the neutral points may be set as the reference positions.

In the foregoing embodiment, regarding outputs of the drive units 31 to 34, the boundary positions are set by detecting the current values of the electric motors 42, 43, and 50 and determining whether or not the output torque has exceeded the determination threshold. However, the boundary positions may be set by detecting change amounts per unit time of strokes and change amounts per unit time of tilt angles of the control levers 10. For example, when the change amounts become equal to or smaller than the determination thresholds, the operation ranges may be set by setting the positions of the control levers 10 at this time as the boundary positions. For example, sensors for detecting the positions of the control levers 10 may be provided, so that outputs of the drive units may be detected by detecting the positions of the control levers 10 (changes in position), and the boundary positions of the control levers 10 may be set.

In the foregoing embodiment, the positions of the control levers 10 when the output torque has exceeded the determination threshold are set as the boundary positions of the operation ranges of the control levers 10. However, positions shifted from the positions of the control levers 10 when the output torque has exceeded the determination threshold by a certain amount may be set as the boundary positions of the operation ranges.

REFERENCE SIGNS LIST

1 Remote control system (remote control device)
2 Construction machine
10 Control lever (control member)
17 Left working lever (control member)
18 Right working lever (control member)
19 Left traveling lever (control member)
20 Right traveling lever (control member)
31 to 34 Drive unit (electric drive unit)
42, 50 First electric motor
43 Second electric motor
52 Control unit
53 Position detection unit
54 Torque determination unit
55 Boundary position setting unit (operation range setting unit)
57 Neutral point storage unit (reference position storage unit)

The invention claimed is:

1. A remote control device comprising:
an electric drive unit controlling a control member;
a position detection unit detecting a position of the control member;
a control unit controlling operation of the electric drive unit;
a reference position storage unit storing information related to a reference position of the control member; and
an operation range setting unit setting an operation range of the control member from the reference position based on an output of the electric drive unit when the control member is displaced by the electric drive unit, wherein
the reference position storage unit stores a control position of the control member at a start of control as the reference position, the control member is a member to control a working machine which is remotely controllable, and the electric drive unit is operated to remotely control the working machine.

2. The remote control device according to claim 1,
wherein the control member is a swingable control lever, and
wherein the reference position storage unit stores a neutral position of the control lever as the reference position.

3. The remote control device according to claim 1,
wherein the electric drive unit includes an electric motor,
wherein the operation range setting unit includes a torque determination unit determining whether or not an output torque of the electric motor has exceeded a determination threshold, and
wherein the operation range setting unit sets the position of the control member when the output torque exceeds the determination threshold as a boundary position of the operation range.

4. The remote control device according to claim 3,
wherein the control unit performs control in which the control member is moved to be displaced in a first direction, stops movement of the control member when the output torque exceeds the determination threshold, and performs control in which the control member is moved to be displaced in a second direction toward a side opposite to the first direction after the control member stops.

5. The remote control device according to claim 1 wherein the electric drive unit is a retrofitted unit to remotely control the working machine.

6. The remote control device according to claim 1 wherein the working machine is a construction machine.

7. A remote control device for a machine including a control member setting a reference position and an operation range based on the reference position, the device comprising:

an electronic drive unit capable of moving the control member from the reference position to a boundary position of an operation range, and controlling the control member by generating a force applicable to move the control member, the force indicated with a determination signal of the electric drive unit; and a controller outputting a command signal to the drive unit, the command signal to drive the drive unit, wherein the controller includes:

a control unit generating the command signal to control an operation of the electric drive unit, a position detection unit detecting a position of the control member with a signal output from an encoder of the electric drive unit, a reference position storage unit storing information related to the reference position of the control member, an operation range setting unit acquiring information on the boundary position of the operation range with a signal that is output from the encoder at a time when the control member is determined to have moved from the reference position to the boundary of the operation range, based on the determination signal.

8. The remote control device according to claim 7 wherein the electric drive unit includes an electric motor, and the determination signal indicates a level of current applied to the electric motor.

9. The remote control device according to claim 8 wherein the controller further includes a torque determination unit determining whether an output torque exceeds a determination threshold, and the control unit is configured to:

cause the control member to move in a first direction, cause the control member to stop moving at a time when the torque determination unit determines that the output torque exceeds the determination threshold value, and after the control unit has stopped, to cause the control member to move in a second direction opposite the first direction.

10. The remote control device according to claim 9 wherein the controller performs a first operation in which the reference position storage unit acquires information on a neutral position with a signal output from the encoder, a second operation in which the control unit is caused to output the command signal to cause the control member to move towards a boundary of the operation range, a third operation in which during the second operation, the torque determination unit determines whether the output torque indicated by the determination signal exceeds the determination threshold value, a fourth operation in which the second operation is kept continued when the torque determination unit determines that the determination threshold value is not exceeded in the third operation, and a fifth operation in which information on the boundary position of the operation range is acquired with a signal that is output from the encoder at a time when the torque determination unit determines that the determination threshold value is exceeded in the third operation.

* * * * *